United States Patent [19]

Weber

[11] 4,149,169

[45] Apr. 10, 1979

[54] CONFIGURATION OF TWO ANTENNAE WITH SIGNAL ISOLATION

[75] Inventor: John W. Weber, Kendallville, Ind.

[73] Assignee: The United States of America as represented by the Secretary of the Army, Washington, D.C.

[21] Appl. No.: 871,045

[22] Filed: Jan. 20, 1978

[51] Int. Cl.[2] ..... H01Q 1/48; H01Q 9/38; H01Q 21/00

[52] U.S. Cl. ..... 343/846; 343/830; 343/725

[58] Field of Search ..... 343/725, 726, 727, 729, 343/730, 829, 830, 846

[56] References Cited

U.S. PATENT DOCUMENTS

| | | | |
|---|---|---|---|
| 3,139,620 | 6/1964 | Leidy et al. | 343/730 |
| 3,665,478 | 5/1972 | Dempsey | 343/725 |
| 3,945,013 | 3/1976 | Brunner et al. | 343/830 |
| 4,030,100 | 6/1977 | Perrotti | 343/725 |

*Primary Examiner*—Alfred E. Smith
*Assistant Examiner*—Harry E. Barlow
*Attorney, Agent, or Firm*—Nathan Edelberg; Sheldon Kanars; Bernard Franz

[57] ABSTRACT

The configuration consists of two antennae on the same mast. The upper antenna is a ground plane capable of two frequency bands of operation. The lower antenna comprises a sleeve and radial elements.

The upper antenna consists of four radials 36" long and an upper element. The two bands of operation covered by the upper antenna are 80 MHz and 150 MHz. Band selection is accomplished by selection of the correct upper mast element. This element is removable. A 34" long element is used for 80 MHz operation and a 14" long element for 150 MHz operation. This antenna is nondirectional and is used for transmitting.

The lower antenna consists of four radials 22" long and an upper and lower sleeve. The radials are insulated from the mast and connected to the center conductor of the coax. The upper sleeve is a portion of this antenna and also isolates the antenna from the mast. The only use of the lower sleeve is to provide isolation of the antenna from the mast and coaxial cable. This antenna is nondirectional and used for receiving at 140 MHz. The upper and lower antenna are isolated by 20 dB.

13 Claims, 5 Drawing Figures

CONFIGURATION OF TWO ANTENNAE WITH SIGNAL ISOLATION

BACKGROUND OF THE INVENTION

This invention relates to configuration of two antennae with signal isolation between them, and more particularly to an antenna configuration for full duplex operation with a transmitting and a receiving antenna on a common mast. It is a frequent requirement that radio equipment at one location be operated with two antennae, as for full duplex operation with a transmitter and receiver operating simultaneously at closely spaced frequencies, or two receivers operating simultaneously. One known configuration has the two antennae elements at right angles for crosspolarization operation, with one vertical and one horizontal, or each at a 45° angle to a ground plane. It is also possible to stack two ground plane configurations vertically, sometimes with the lower configuration inverted. One disadvantage of these prior art arrangements is the amount of space, or overall size, of the resulting configuration. Also the amount of isolation might not be as sufficient for convenient operation.

SUMMARY OF THE INVENTION

An object of the invention is to provide a configuration of two antennae which is reasonably compact in size, with good signal isolation.

The configuration according to the invention is mounted on a mast having a metallic tube with the feedline inside; with a first antenna in a ground plane form at the outer end of the mast with a single radiating element colinear with the mast connected to the center conductor of its feedline, and a set of radial elements grounded to the mast and to the shield of its feedline; a second antenna having a set of radials electrically isolated from the mast and connected to the center conductor of its feedline with the shield connected to the mast, and a first sleeve in the form of a metal tube around the mast between the two sets of radials metallically connected to the mast near the second set of radials and electrically isolated near the first set of radials; and a second sleeve in the form of a metal tube around the mast on the other side of the second set of radials electrically isolated from the mast near the second set of radials and metallically connected thereto at its other end, to form a choke to provide isolation of the antenna from the mast and the feedlines, each sleeve being a quarter wavelength for the second antenna.

In the preferred embodiment the mast is vertical, and the two sets of radials are in horizontal planes for operation.

THE DRAWINGS

DETAILED DESCRIPTION

There are different embodiments of the antenna configuration for use in a system, which differ slightly according to the particular use and frequencies. One exemplary embodiment which fully discloses the preferred form of the invention is described below.

Figure 1:
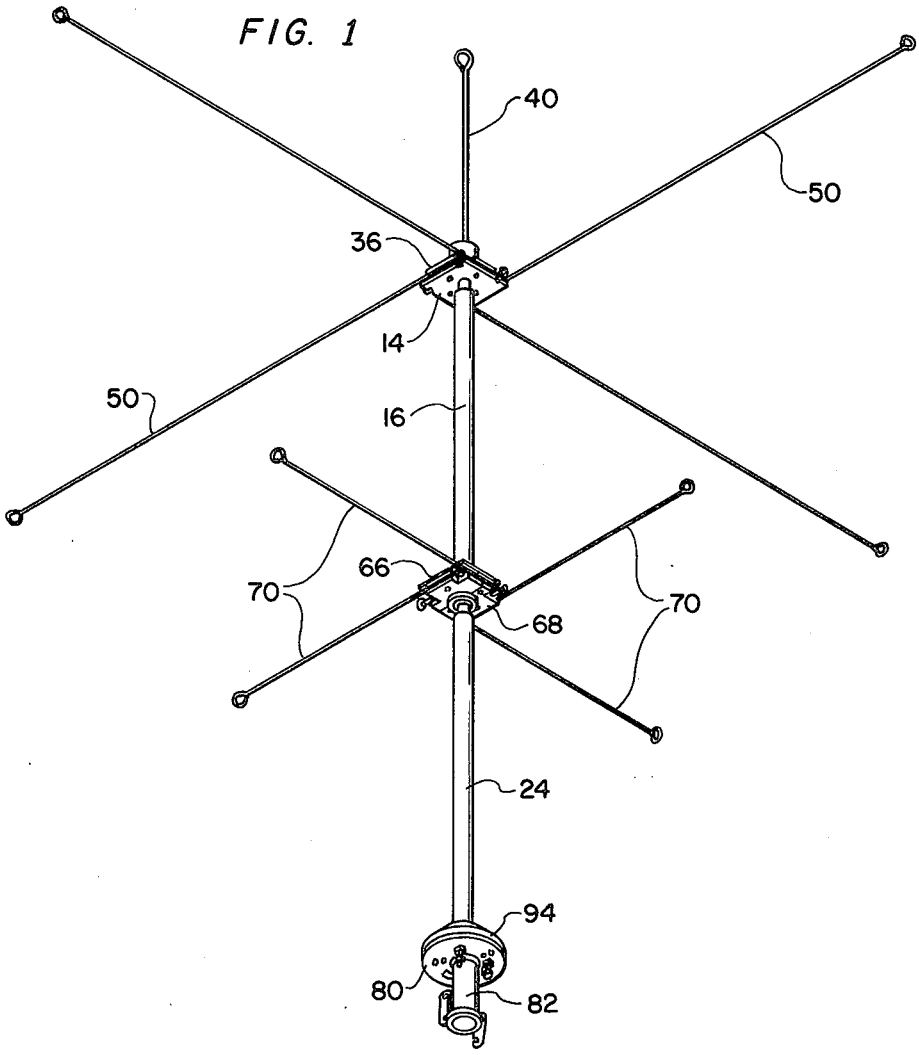
FIG. 1 is a pictorial view of the antenna configuration.
Figure 2:
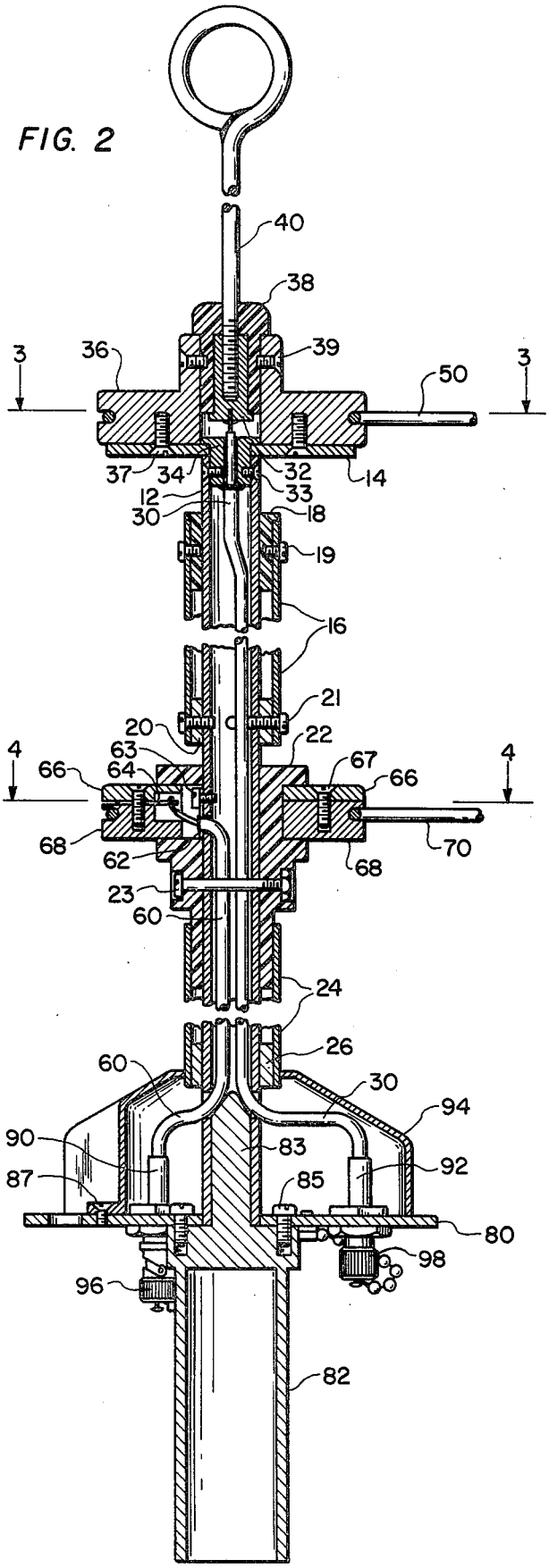
FIG. 2 is a vertical sectional view of the antenna configuration.
Figure 4:
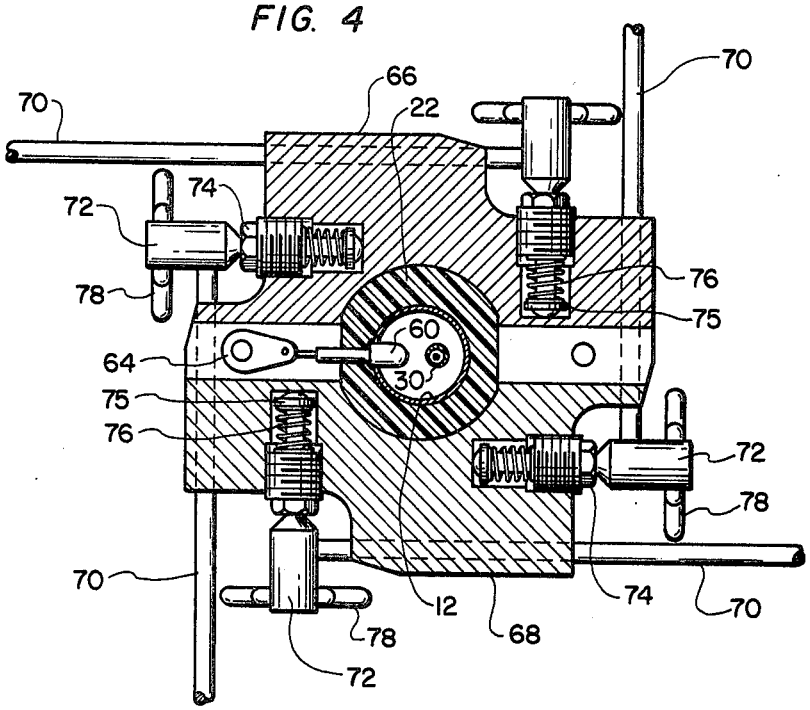
FIG. 4 is a horizontal section along lines 4—4 of the holder for the lower radials.
Figure 5:
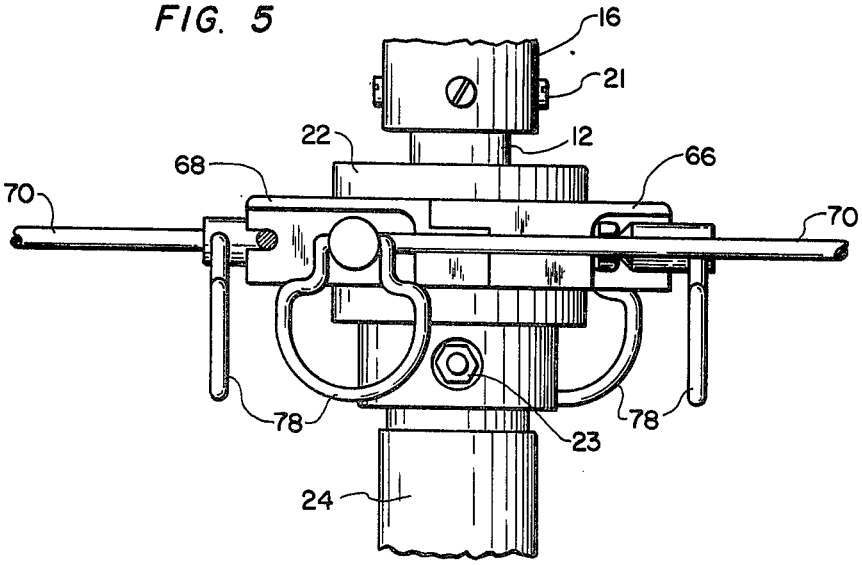
FIG. 5 is an elevational view from the right hand side of the vicinity of the lower antenna holder.

Referring to FIGS. 1 and 2, the antenna configuration consists of two antennae on the same mast. The upper antenna is a ground plane capable of two frequency bands of operation. The lower antenna comprises a sleeve and radial elements.

The upper antenna consists of four radials, 50 which are 36" long and an upper element 40. The two bands of operation covered by the upper antenna are 80 MHz and 150 MHz. Band selection is accomplished by selection of the correct upper mast element 40. This element is removable. A 34" long element is used for 80 MHz operation and a 14" long element for 150 MHz operation. This antenna is nondirectional and is used for transmitting. It is terminated by a BNC connector 92 on the antenna assembly guy plate 80.

The lower antenna consists of four radials 70 which are 22" long, an upper sleeve 16 and lower sleeve 24. The radials 70 are insulated from the mast and connected to the center conductor of the coax. The upper sleeve 16 is a portion of this antenna and also isolates the antenna from the mast. The only use of the lower sleeve 24 is to provide isolation of the antenna from the mast and coaxial cable. This antenna is nondirectional and used for receiving at 140 MHz. It is terminated with a TNC connector 90 on the antenna assembly guy plate 80. The upper and lower antennae are isolated by 20 dB.

In FIGS. 2–5, the antenna elements are shown broken away. In FIG. 2 the mast structure is shown broken between the upper holder 36 and lower holder 66–68 , and also between the lower holder and the structure on guy plate 80.

The assembly of the antenna configuration begins with an inner mast element 12 which is an aluminum alloy tube 45.88 inches long, with inner and outer diameters of 0.493 and 0.675 inches, respectively, extending from the upper holder 36 to the guy plate 80. At the top end there is heliarc welded a rectangular mast plate 14 of aluminum alloy 2.900×2.600×0.125 inches. The plate has a center hold equal to the inner size of the tube 12. There are four holes in the plate, with the center of each 0.800 inch from the center of the plate along lines parallel to the sides, each hole being 0.175 to 0.180 inches diameter countersunk at 82° to 0.315 diameter. There is a notch in each side of the plate 0.850 inch from the center line with a slope of 15° toward the center, and the outer side 0.06 radius by 0.06 inch deep.

In the tube 12 there are four holes for screws 33 with centers 0.375 inch below the bottom of the plate, each of 0.125 diameter countersunk 82° to 0.211 inch diameter. There are two holes with centers 1.43 inches from the bottom of tube 12 along a diameter rotated 18° from the diameter parallel to the long sides of plate 14, with a diameter of 0.250 inch, for the coaxial cables 30 and 60. At a distance of 22.62 inches from the bottom of the tube there are two holes for bolt 23, each hole 0.177 inch diameter. At a centerline distance of 1.06 inch above the center of the last mentioned holes there is one hole for screw 63, threaded through for 0.112-40 UNC-2B. Centered 0.320 inch below there is a hole of 0.31 inch diameter for cable 60. Centered 1.95 inches above the holes for bolt 23 there are four holes for screws 21 threaded for 0.112-40 UNF-2B helical coil threaded inserts. The tube and plate are painted, except for 3.00 inches at the bottom, an area from 0.25 inch above the hole for screw 23 to the bottom of the cable hole just below it, and an area 0.25 inch above and below the center of the holes for screws 21.

The next item is an insulator 18 for sleeve 16. This insulator is made of TFE-Fluorocarbon (TEFLON). It has a main portion 0.75 inch long and 1.043 inch diameter, with an upper lip of 1.16 inch diameter and 0.06 inch thick. The inside has a diameter of 0.685 inch. There are two holes centered 0.380 inch below the lip, threaded for 0.112-40 UNC-2B helical coil inserts.

The sleeve 16 is an aluminum tube 20.69 inches long with inner and outer diameters of 1.055 and 1.125 inches. At the top centered 0.375 inch down there are two holes of 0.125 inch diameter; and centered 0.25 inch from the bottom there are four holes of 0.125 inch diameter. The sleeve 16 slides over the tube 12 and insulator 8, and fastened with two screws 19. Inside the bottom of sleeve 16 there is a metal spacer sleeve 20, which is 0.50 inch long, with inner and outer diameters of 0.685 and 1.043 inches. There are four holes of 0.125 inch diameter for screws 21; and also two vertical holes centered 0.42 inch from the center 0.10 inch diameter along a diameter rotated 45° from the other holes, these vertical holes being for drainage, etc. The spacer sleeve is securely welded to both the inner tube 12 and to the sleeve 16.

A holder insulator 22 is placed on the inner tube 12 0.325 inch below the sleeve 16. This insulator 22 is made of plastic molding material, acetal (DELRIN) type 1, class 2, color black, finished with varnish. The shape of the insulator is generally cylindrical, starting at the top with a portion of diameter 1.75 and length 0.25 inch, a second portion of 1.187 diameter and 0.620 inch long, a third portion of the same dimensions as the top, a fourth portion of 1.50 diameter and 0.55 length, and a bottom portion of 1.043 diameter and 1.20 inches long, all of these portions being one integral unit. There is a center hole of 0.685 diameter for sliding onto tube 12. The second portion is flattened on two sides to a diameter of 1.100 inches, and one of these sides is open to the inside with a hole 0.450 inch wide, and the full length of this second portion, to provide passage for the end of cable 60. There are two holes in the fourth portion through with a diameter of 0.177 inch and an outer part 0.25 inch deep of diameter 0.406 inch, centered 1.45 inch from the bottom of the insulator, for the bolt 23 and its nut. Both ends of the inner vertical hole are chamfered 0.6×45°.

The lower sleeve 24 is an aluminum alloy tube 20.56 inches long, with inner and outer diameters of 1.055 and 1.125 inches. It slides on over tube 12, with its upper end over the bottom portion of the insulator 22 to a distance 0.200 inch from the bottom of the fourth portion thereof. The bottom of the sleeve 24 is flush with the top edge of the holes for the cables, or 1.575 inches from the bottom end of tube 12.

The metal spacer sleeve 26 in the bottom end of sleeve 24 is identical to spacer sleeve 20 for the upper sleeve, and is securely welded to both the inner tube 12 and to the sleeve 24.

The coaxial cable 30 is type RG-142 B/V with an overall length of the center conductor of 52 inches. The cable is prepared with a socket 32 and a connector 34 on one end, and then inserted through the inner mast tube 12. The preparation has the outer sheath removed a distance of 0.968 inch, the shield has an exposed length of 0.562 inch, the insulation between conductors has a length of 0.671 inch measured from the sheath, and the center conductor is stripped for a length of 0.297 inch from the end.

The connector 34 at the top end of tube 12 is of soft brass alloy, in cylindrical form with the main section 0.53 inch long and 0.485 inch diameter; and an upper lip 0.06 inch thick and 0.670 inch diameter. There are four screw holes centered 0.375 inch below the lower edge of the lip threaded through for #4-40 UNC-2B. A center axial hole has a diameter of 0.195 inch, with a 0.060×45° chamfer at the bottom end. There are two small vertical holes along a diameter rotated 45° from the screw holes, 0.167 inch from the center with diameters of 0.055 inch. The bottom of the connector has a 0.015×45° chamfer. The connector 34 is placed on the end of the cable 30, and soldered to the shield at the bottom of the connector.

The socket 32 is soft brass alloy in cylindrical form, with a main section 0.940 inch long and 0.385 inch diameter flattened on two opposite sides to a diameter of 0.385 inch diameter flattened on two opposite sides to a diameter of 0.285 inch; and a lower lip 0.09 inch thick and 0.50 inch diameter. At the bottom there is a center hole of 0.045 diameter and 0.20 inch deep, with a 0.02 45° chamfer. There is a center hole with a total depth of 0.780 inch from the top drilled and tapped for 10-24-NC-2B threads, and the top of the hole is enlarged to a diameter of 0.187 inch to a depth of 0.28 inch. The socket is hot-dip tin plated. The center conductor of the cable 30 is soldered into the bottom hole, leaving a distance of 0.375 inch between the upper edge of the lip of the socket 32 and the lower edge of the lip of the connector 34.

The cable assembly is inserted with the main section of the connectors 34 inside the upper end of the inner mast tube 12, and held by four screws 33.

Figure 3:
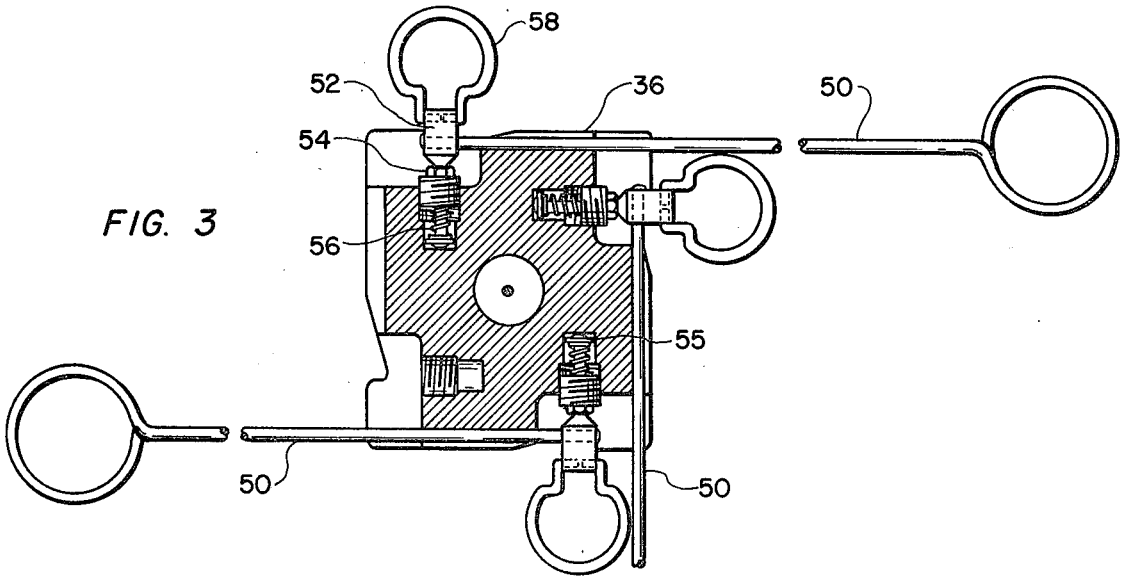
FIG. 3 is a horizontal section along lines 3—3 of the holder for the upper radials.

The upper antenna element holder 36 (see FIGS. 1, 2, and 3) of cold rolled steel, has a main rectangular section of dimensions 3.160×2.833×0.610 inches, and a cylindrical upper section of 1.18 inch diameter, the overall vertical dimension of the two sections being 1.30 inches. A center vertical cylindrical hole has a diameter of 0.687 inch. In the bottom there are four screw holes 0.50 inch deep tapped with 0.164-32-UNC-2B threads, centered 0.800 inch from the center along lines through the center parallel to the sides. In the upper section there are two side holes for screws 39, tapped through with 0.138-32-UNC-2B threads, countersunk 82° to 0.265 diameter, the holes being centered 0.312 inch from the top. There is a vertical slot in one side of the center hole at the top, which is 0.125 inch wide, cylindrical shaped at its outer edge to a distance of 0.468 inch from the center, and a vertical dimension of 0.38 inch from the top. The upper and lower edges of the rectangular portion are rounded on all four sides to a 0.06 inch radius, as well as the four vertical corners. The cylindrical portion has a 0.06×45° chamfer at the top. The four corners of the rectangular portion are cut out, so that looking at each corner from the top there is a dimension of 1.13 inches to the right and 0.530 inch to the left, and vertical dimension which leaves 0.06 inch remaining at the bottom with a 0.12 inch radius in eight places between the vertical and horizontal surfaces, and the vertical inner corners also having a similar radius. From the longer side of the cutout in each corner, a hole is drilled with a horizontal axis, with center 0.700 inch and 0.860 inch from the center lines parallel to the sides of the rectangle on its short and long sides, respectively. The centers are 0.305 inch above the bottom surface of the holder 36. The holes have a flat bottom 1.062 inches from a reference line, which reference line is 0.130 inch from the edge of the rectangle. The diameter is 0.312 inch. The holes are tapped 0.375-16-UNC-25 to a depth of 0.300 inch, which is 0.700 inch from the reference line. The intersection of the reference line and the projection of the axis of the hole at each corner is the center of a 0.070 inch radius for one end of a notch, so that the bottom of the notch is 0.200 inch from the edge of the rectangle, and from the bottom each notch extends at an angle of 15° toward the center line. Slots are cut on the four sides in the part remaining after corners are cutout, with horizontal axes 0.305 inch above the bottom surface of the holder 36, the slots being 0.140 inch wide with a 0.070 inch radius semicylindrical bottom. In FIG. 3, one of the four radials 50 and its mounting hardware, on the left side, is omitted to more clearly show the hole and slot. The holder is painted except in the slots and on the bottom surface. It is fastened to the plate 14 with four screws 37.

The antenna insulator 38 is made of acetal plastic molding material (DELRIN), and finished with varnish. It has an overall vertical length of 1.330 inches. The main portion has a length of 0.950 inch and is cylindrical with a diameter of 0.675 inch. At the top of this portion there is a projection with a vertical length of 0.25 inch, extending to 0.463 inch from the center axis, and having a radius of 0.060 inch making its width 0.120 inch. This projection mates with a slot in holder 36. The top portion of the insulator 38 has a diameter of 0.89 inch, and its sides have a radius of 0.25 inch. A center vertical hole in the main portion for its length of 0.950 inch has two opposite sides cylindrical with a diameter of 0.400 inch and the other two sides flat equidistant from the center with a width of 0.300 inch. The socket 32 fits into this hole. The top portion has a vertical center hole of 0.191 inch diameter. At two places on opposite sides of the main portion there are flattened spots with a vertical dimension of 0.160 inch × 0.03 inch deep; the top edge being 0.234 inch below the lower surface of the top portion. The two screws 39 engage the flat places after the insulation is inserted into the holder 36.

The top antenna element 40 is made of cold rolled steel rod of 0.187 inch diamter. The bottom end has 10-24-UNC-2A threads for a length of 0.750 inch. It fits through the top hole of insulator 38 threads into the hole in socket 32. For safety to the eyes, etc., the outer end of this end and the other antenna elements have a loop with a 1.25 inch inside diameter, with a radius of 0.38 inch between the straight part and the loop, and having the end silver brazed to close the loop. A plastic knob may be used on the end of the rod instead of the loop. The rod is painted except for the threads. For operation in the 80 megahertz band the overall length is 13.375 inches (nominally 14 inches). For operation in the 150 megahertz band an element with a nominal length of 34 inches is used.

There are four upper radial antenna elements 50. Each rod has an overall length of 36.687 inches, and a diameter of 0.125 inch. The loop at the outer end is the same as on the top antenna element. The inner end of the element is inserted into and silver brazed to a grip 52. The grip is cylindrical with an overall length of 1.38 inches. One end has a diameter of 0.125 inch for a length of 0.85 inch, the other end has a diameter of 0.312 inch, the two ends being joined by a taper of 45°. There are two holes in the large end perpendicular to the long axis, centered 1.30 inches and 1.38 inches from the far end, with diameter of 0.130 inch and 0.095 inch, respectively. The antenna element 50 is inserted in the larger of these holes, and the other is for a bale. There is a hole in the small end coaxial with the main axis having a diameter and depth both 0.093 inch. A radial nut 54 has an overall length of 0.400 inch, having a main portion 0.300 inch long with ⅜-16 UNC-2A threads. One end is hexagonally shaped with a diameter of 0.250 inch between the flat surfaces. A hole through the length has a diameter of 0.128/0.133 inch, enlarged at the end opposite the hexagonal part to a length and diameter both 0.220 inch. This radial nut 54 fits over the small end of 52 with the hexagonal end on first. A helical compression spring goes on after the nut and a roll over on the end of the grip holds it in place. The spring is 0.032 inch diameter music wire formed into a helix of 0.200 inch diameter, with a free length of 0.610 inch after both ends are ground squared. The direction of the helix is optional, with a total of 8 coils, 7 of which are active. It is finished with unbleached chromate—passivated cadmium. The antenna element 50, grip 52, nut 54 and seat 55 are made of cold rolled steel.

A spring seat 55 which is 0.50 inch thick with a diameter of 0.300 inch and a hole with a diameter of 0.125 inch fits on the end of the grip after the spring, and a roll over is then formed on the end of the grip to fasten the parts together. A bale 58 of hi-carbon steel wire, 0.091 inch diameter is formed and fits into the smaller hole of grip 52. The main part of the bale has a radius of 0.44 inch, and on each side has a straight section followed by a 90° inward bend and another 90° bend inward with a 0.02 inch radius so that the two ends meet with a maximum clearance of 0.03 inch, and the inside length is 1.00 inch. The antenna element rods are painted except for a length of 1.50 inches starting 0.40 inch from the axial center line of the grip 52.

In normal operation the radial antenna elements 50 fit into the slots of holder 36 and thereby extend horizontally in four directions, with the unpainted area in the slots so that there is a good electrical path through the holder 36, plate 14, and connector 34 to the shield of cable 30. For transporting the antenna configuration, the elements 50 may be folded by pulling on bale 58 to lift them from the slots and rotating them into the notches so that they are then along side of the sleeve 16.

The coax cable 60 is the feedline for the lower antenna. It has an overall length of 30 inches. At the upper end the outer sheath is removed to 0.343 inch from the end, the shield is cut to expose a length of 0.140 inch, the inner insulation is cut to a length of 0.934 inch from the sheath, leaving 0.109 inch of the center conductor exposed. A standard lug terminal 64 having a small conductor hole and a larger screw hole is used, with the center conductor bent over and soldered into the small hole. For connecting the shield, a special coax collar 62 is formed from soft alloy brass bent as a cylindrical partial surface with a 0.450 inch radius, a length of 0.60 inch parallel to the cylinder axis, and a width 0.44 inch measured across the arc. A hole has a center 0.120 inch from one end equidistant from the sides with a diameter of 0.140 inch. A slot at the other end has a center 0.320 inch from the center of the hole, and a radius of 0.100 inch cutout to the side so that its width is 0.20 inch. The collar is finished with hot-dip tin plate. It is fitted with its slot over the shield of the cable 30 and soldered thereto. The collar is placed so that its cylindrical surface fits over the outer surface of tube 12, and a screw 63 through the hole fastens it to the tube.

The lower antenna element holder is formed of two pieces 66 and 68 (see FIGS. 1, 2, 4, and 5) of cold rolled steel. These two pieces are fitted into the second portion of insulator 22 and fastened together, to form a structure very similar to the upper holder 36. Each of the two pieces is 3.160 inches long and 0.610 inch thick overall. Measuring from the center line through the holes for the two screws 67, piece 66 is 1.410 inches wide, and piece 68 is 1.423 inches wide, giving a total width for the two pieces of 2.833 inches. Thus the total overall dimensions of the holder 66, 68 are the same as those of the upper holder 36. As shown best in FIG. 5, pieces 66 and 68 have sections at the top and bottom, respectively, which overlap to fasten the holder together with screws 67. This overlapping section on piece 66 is 0.397 inch wide with the screw center line 0.200 inch from the edge, and is 0.180 inch thick. The overlapping section on piece 68 is 0.397 inch wide with the screw center line 0.187 inch from the edge, and is 0.422 and 0.404 inch thick on the right and left sides (FIG. 2), respectively. This provides space between the two pieces for the lug terminal 64. The left screw 67 goes through the hole of the lug terminal. The center distance between the two screw holes is 2.250 inches. In piece 66 the holes are drilled through with a diameter of 0.177 inch countersunk 82° to 0.315 inch diameter; and in piece 68 they are drilled and tapped for 0.164-32 UNC-2B threads by 0.34 inch deep. The four corners of the holder 66, 68 are cutout, with holes for mounting the radial elements, slots, and notches in the same manner as on the upper holder 36, except that it is inverted so that the cutouts are on the bottom and the notches are above.

The four lower radial antenna elements 70 are the same as the upper radial elements 50, except for the length, which is 20.875 inches. Each element has a grip 72, a radial nut 74, a spring 76, a spring seat 75, and a bale ring 78; which are identical to the corresponding parts 52, 54, 56, 55, and 58 for the upper elements. They mount in the four corners of holder 66, 68. In operation the radial elements are extended in the horizontal plane in their respective slots on the four sides of holder 66, 68. For transportation, they fold alongside of sleeve 16.

Thus the lower antenna comprises the four radial elements connected through the holder 66, 68 and lug terminal 64 to the center conductor of cable 60, isolated from the mast by insulator 22; and sleeve 16 connected through sleeve 20, mast tube 24, and collar 62 to the shield of cable 60.

At the bottom of the antenna configuration there is a round guy plate 80 of aluminum alloy welded to the end of the inner mast tube 12. The plate is 0.125 inch thick, with an outer diameter of 5.000 inches, and a center hole of 0.875 inch diameter. There are four mounting holes, two along the section line of FIG. 2, and two along the diameter orthogonal thereto, each having its center 0.625 inch from the plate center, and 0.175 inch in diameter. There are two coax connector holes, one with its center 1.52 inches behind the section line and 0.50 inch to the left of the orthogonal line, and the other 0.50 inch behind the section line and 1.52 inches to the right of the orthogonal line; each hole being generally round with a diametr of 0.505 inch but with one side on the right being straight 0.220 inch from the center. There are two screw holes for attaching dust cap chains, one 0.31 inch to the left and 0.95 inch behind the section line, and the other 0.95 inch to the right and 0.31 inch behind the section line. There are three guying holes of 0.400 inch diameter, one with its center along the section line to the left in FIG. 2, and the others 120° therefrom, each centered 2.113 inches from the plate center. Along the same radii as the guying holes there are three screw holes for mounting a cover 94, each centered 1.550 inches from the plate center. The five screw holes (three for the cover and two for the dust caps) are each threaded for and have installed therein a 0.138-32-UNC-2B helical coil threaded insert.

An antenna mast base 82 of aluminum alloy extends a total of 4.00 inches below the guy plate 80. An upper post 83 of the base 84 having a diameter of 0.480 inch extends into the inner mast element 12 a distance of 1.25 inches plus a point at the top with a 45° slope rounded at the tip with a 0.09 inch radius. The portion immediately below the guy plate has a diameter of 1.56 inches for a distance of 0.52 inch. On the top of this portion there are four screw holes centered 0.625 inch from the center, each threaded for and having installed therein a 0.164-32 UNF-2B helical coil threaded insert. The lower portion for a length of 3.48 inches has an outside diameter of 1.345 inches; and for a length of 3.50 inches is tubular with an inside diameter of 1.140 inches. The base 82 is fastened to the guy plate 80 with four screws 85.

The cover 94 is made of black glass fiber reinforced nylon 6/6 which is 0.06 inch thick. The outer wall is generally cylindrical with an outer diameter of 4.370 inches and a height of 0.75 inch, above which there is a slopping portion of 30° to the horizontal joined to the outer wall by a 0.12 inch radius, to a flat portion on top having a 0.687 inch hole, with an overall height of 1.68 inches. At three places in the outer wall spaced 120° there are semicircular recesses inward with a radius of 0.72 inch centered 2.02 inches from the center of the cover. Each recess at the bottom has a horizontal outward projection with a 0.152 inch diameter hole countersunk 82° to 0.260 inch, for screws 87 to fasten the cover 94 to the guy plate 80.

After the guy plate 80 is welded to the mast element 12, the cover 94 is removed to a place where its lower edge is flush with the bottom edge of sleeve 24 to allow painting of the guy plate 80, the base 82, and the mast assembly. After painting, the coax connectors 90 and 92 are assembled, and the dust caps 96 and 98 have the lug at the end of the chain attached to the guy plate 80.

The entire assembly is mounted on top of a mast (not shown), with three guy lines (not shown) attached to the guy plate 80.

What is claimed is:

1. An antenna configuration comprising an inner tubular element of conducting material;

a first antenna of the ground plane type having a first radiating element and a plurality of first radial elements;

a first transmission line extending through said inner tubular element with one conductor connected via an electrically conductive path to said first radiating element and another conductor connected via an electrically conductive path to said first radial elements;

a second antenna comprising a plurality of second radial elements and a first sleeve in tubular form around said inner tubular element between said first radial elements and said second radial elements, said first sleeve being electrically conductively connected to the inner tubular element at its end nearest the second radial elements and being electrically insulated for its remaining length; said second radial elements being electrically insulated from the inner tubular element;

a second transmission line extending through said inner tubular element with one conductor connected via an electrically conductive path to said second radial elements and another conductor connected via an electrically conductive path to said first sleeve at its end nearest the second radial elements.

2. An antenna configuration as set forth in claim 1 further including a second sleeve in tubular form around said inner tubular element opposite said second radial elements from said first sleeve, the second sleeve being electrically connected to the inner tabular element at its end remote from said second radial elements and electrically insulated for its remaining length; with both said first and second transmission lines extending within said inner tubular element beyond said electrical connection of the second sleeve to the inner tubular element.

3. An antenna configuration as set forth in claim 2, wherein said first and second transmission lines are each a coaxial cable with inner and outer conductors; said first transmission line has its inner conductor connected to the first radiating element and its outer conductor connected to the first radial elements; and said second transmission line has its inner conductor connected to the second radial elements and its outer conductor connected to said first sleeve.

4. An antenna configuration as set forth in claim 2, wherein said first antenna may be operated in different frequency bands by selection of a first radiating element of the proper length, with the first radial elements of a fixed length.

5. An antenna configuration as set forth in claim 3, wherein when the configuration is in position for normal operation, said inner tubular element is substantially vertical, and said first radiating element extends substantially vertically above the upper end of the inner tubular element.

6. An antenna configuration as set forth in claim 5, wherein said first and said second radial elements are respectively substantially in first and second horizontal planes.

7. An antenna configuration as set forth in claim 5, wherein said first and said second sleeve are each substantially a quarter wavelength for the frequency band of said second antenna with the second sleeve acting only as a choke to provide isolation of the antenna from the inner tubular element and the first and second transmission lines.

8. An antenna configuration as set forth in claim 6, further including a first holder for said first radial elements and a second holder for said second radial elements, the first holder being part of the electrically conductive path between the outer conductor of the first transmission line and the first radial elements and electrically connected to the inner tubular element; the second holder being part of the electrically conductive path from the inner conductor of the second transmission line and being electrically insulated from the inner tubular element.

9. An antenna configuration as set forth in claim 7, wherein said first antenna may be operated in different frequency bands, with the first radial elements being a fixed length which is substantially a quarter wavelength for the lower frequency band, and the first radiating element being changeable with a length selected for the desired frequency band, which is substantially shorter than a quarter wavelength for higher frequency bands.

10. An antenna configuration as set forth in claim 8, wherein for storage and transportation said first radiating element is removable, and said first and said second radial elements are arranged in their respective holders to fold each alongside one of said sleeves.

11. An antenna configuration as set forth in claim 8, wherein the electrically conductive connections between said first sleeve and said second sleeve at the lower end of each of the inner tubular element, each comprises an inner electrically conductive tubular element of short length inserted between the inner tubular element and the respective sleeve.

12. An antenna configuration as set forth in claim 10, wherein said first antenna may be operated in different frequency bands by selection of a first radiating element of the proper length, with the first radial elements of a fixed length.

13. An antenna configuration as set forth in claim 11, wherein the electrically conductive path to the first sleeve comprises a connection of the outer conductor of the second transmission line to the inner tubular element near said second radial elements.

* * * * *